US007449824B2

(12) United States Patent
Moribe et al.

(10) Patent No.: US 7,449,824 B2
(45) Date of Patent: Nov. 11, 2008

(54) SPARK PLUG

(75) Inventors: Mai Moribe, Aichi (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 40 days.

(21) Appl. No.: 11/513,035

(22) Filed: Aug. 31, 2006

(65) Prior Publication Data

US 2007/0046162 A1 Mar. 1, 2007

(30) Foreign Application Priority Data

Sep. 1, 2005 (JP) ..... 2005-254211
Feb. 24, 2006 (JP) ..... 2006-048684
Jul. 7, 2006 (JP) ..... 2006-187505

(51) Int. Cl.
*H01T 13/00* (2006.01)
*H01T 21/02* (2006.01)

(52) U.S. Cl. ..... 313/144; 313/143; 313/118; 29/888.01; 445/7

(58) Field of Classification Search ..... 313/143, 313/144
See application file for complete search history.

(56) References Cited

U.S. PATENT DOCUMENTS 6,111,345 A * 8/2000 Shibata et al. ..... 343/141
6,170,451 B1 * 1/2001 Moriya ..... 123/169 PA
6,414,420 B1 * 7/2002 Suzuki ..... 313/144
6,548,945 B1 4/2003 Tamura
6,741,015 B2 5/2004 Suzuki et al.
6,849,995 B2 2/2005 Suzuki
7,049,734 B2 5/2006 Tamura
2002/0105254 A1 * 8/2002 Hori et al. ..... 313/141
2005/0017622 A1 1/2005 Tamura

FOREIGN PATENT DOCUMENTS

DE 962 481 4/1957
DE 30 08 963 A1 9/1981
DE 198 59 508 A1 7/1999
DE 103 12 791 A1 9/2004
JP 2002-164147 A 6/2002
JP 2003-257583 9/2003
JP 2003-257583 A 9/2003
JP 2005-44627 2/2005
JP 2005-44627 A 2/2005
WO WO 2004/086581 A1 10/2004

* cited by examiner

*Primary Examiner*—Nimeshkumar D. Patel
*Assistant Examiner*—Thomas A Hollweg
(74) *Attorney, Agent, or Firm*—Sughrue Mion, PLLC

(57) ABSTRACT

A spark plug is provided with a metal shell and a ceramic insulator to support therein a center electrode. The ceramic insulator includes a front portion with a stepped outer surface, a middle portion, a rear portion and a shoulder portion defined between the middle and rear portions. A difference between the outer diameters of the middle and rear portions of the ceramic insulator is 1.8 mm or smaller. The metal shell includes a radially inward protrusion to retain thereon the stepped outer surface of the ceramic insulator and a rear end portion crimped onto the shoulder portion of the ceramic insulator. An inner circumferential surface of the crimped shell portion has a region held in contact with the insulator shoulder portion with a radially innermost point of the crimped shell portion being spaced radially apart from the ceramic insulator and axially apart from the insulator shoulder portion.

7 Claims, 14 Drawing Sheets

SPARK PLUG

BACKGROUND OF THE INVENTION

The present invention relates to a spark plug, particularly of small-diameter type, for use in an internal combustion engine. Hereinafter, the term "front" refers to a spark discharge side with respect to the direction of the axis of a spark plug, and the term "rear" refers to a side opposite to the front side.

A spark plug of an internal combustion engine generally includes a metal shell and a ceramic insulator supporting therein a center electrode and a terminal electrode insulatively. The ceramic insulator is held in the metal shell by seating a stepped outer surface portion of the ceramic insulator against a protruded inner surface portion of the metal shell and crimping a rear end portion of the metal shell onto a shoulder portion of the ceramic shell. There are several methods for crimping the metal shell onto the ceramic insulator. In one crimping method, the metal shell is deformed by cold forging with an insulating powder material filled between the metal shell and the ceramic insulator as discussed in Japanese Laid-Open Patent Publication No. 2005-044627. In another crimping method (called "hot crimping"), the metal shell is deformed by plastic forming under heated conditions where the deformation resistance is low, without the use of an insulating powder material, as discussed in Japanese Laid-Open Patent Publication No. 2003-257583.

The size (diameter) reduction of the spark plug is being demanded to attain a higher degree of engine design flexibility for improvement in engine performance such as engine output and efficiency. For example, the diameter reduction of the spark plug leads to the formation of a smaller plug hole and permits the arrangement of a lager water jacket and intake/exhaust ports in the engine. Further, the spark plug is mounted in the plug hole by engaging a plug mounting tool e.g. a plug wrench on a tool engagement portion of the metal shell so that the diameter of the plug hole has to be controlled allowing for the outer diameter of the plug mounting tool. The diameter reduction of the tool engagement portion is thus particularly effective in increasing engine design flexibility.

It is however undesirable to decrease the thickness of the tool engagement portion in order to reduce the outer diameter of the tool engagement portion because the tool engagement portion is subjected to a large torsional strain during the mounting of the spark plug into the plug hole. In order to reduce the outer diameter of the tool engagement portion without decreasing the thickness of the tool engagement portion, a middle portion of the ceramic insulator, which corresponds in axial position to the tool engagement portion, could conceivably be reduced in diameter. In this case, there is no need to make a design change in a rear portion of the ceramic insulator and reduce the diameter of the rear insulator portion excessively, thereby enabling the use of a conventional plug cord and preventing an increase in the possibility of a break in the ceramic insulator.

SUMMARY OF THE INVENTION

In the ceramic insulator, the shoulder portion is formed between the middle and rear insulator portions. The ratio of coverage of the crimped shell portion on the insulator shoulder portion thus becomes too low to hold the ceramic insulator in the metal shell securely when the outer diameter of the middle insulator portion is reduced to such an extent that there is only a difference of 1.8 mm or smaller between the outer diameters of the middle and rear insulator portions. This results in various problems such as slipping of the ceramic insulator out of the metal shell and combustion gas leakage from between the metal shell and the ceramic insulator. If the shell end portion is crimped onto the insulator shoulder portion so as to attain a higher coverage ratio, the inner edge of the crimped shell portion may come into contact with the ceramic insulator and cause a break in the ceramic insulator.

It is further conceivable to arrange a metal packing between the crimped shell portion and the insulator shoulder portion as disclosed in Japanese Laid-Open Patent Publication No.2003-257583. In the case of the small-diameter spark plug, however, the metal packing cannot be placed in a proper position inside of the metal shell when the inner diameter of the metal packing is large relative to the outer diameter of the rear insulator portion. The crimping of the shell end portion onto the insulator shoulder portion is interfered with by the metal packing unless the wire diameter of the metal packing is made sufficiently small. Even if placed inside the metal shell, the metal packing of such small wire diameter becomes a cause of local load to induce a break in the ceramic insulator during the crimping of the shell end portion onto the insulator shoulder portion. When the inner diameter of the metal packing is as small as the outer diameter of the rear insulator portion, by contrast, the metal packing is placed in a rearward position on the insulator shoulder portion with respect to the shell end portion. The shell end portion cannot be properly crimped onto the insulator shoulder portion so as to accommodate the metal packing in between the crimped shell portion and the insulator shoulder portion. In addition, the crimping of the shell end portion onto the insulator shoulder portion causes a compressive load to slide the metal packing against the insulator shoulder portion and induce a break in the ceramic insulator.

It is therefore an object of the present invention to provide a spark plug capable of holding a ceramic insulator in a metal shell securely without causing problems such as a break in the ceramic insulator even when the spark plug is of small-diameter type where there is only a small difference (1.8 mm or smaller) in outer diameter between middle and rear portions of the ceramic insulator.

It is also an object of the present invention to provide a method for manufacturing such a small-diameter spark plug.

According to an aspect of the present invention, there is provided a spark plug, comprising: a center electrode; a-ceramic insulator being formed with an axial through-hole to support therein the center electrode and including a front portion with a stepped outer surface, a middle portion made larger in outer diameter than the front portion, a rear portion made smaller in outer diameter than the middle portion and a shoulder portion defined between the middle and rear portions, a difference between the outer diameters of the middle and rear portions of the ceramic insulator being 1.8 mm or smaller; a metal shell being formed with an axial through-hole to hold therein the ceramic insulator and including a tool engagement portion adapted to engage with a plug mounting tool, a radially inward protrusion formed in the axial through-hole of the metal shell to retain thereon the stepped outer surface of the ceramic insulator and a portion located on a rear side of the tool engagement portion and crimped onto the shoulder portion of the ceramic insulator, an inner circumferential surface of the crimped shell portion having a region held in contact with the insulator shoulder portion with a radially innermost point of the crimped shell portion being spaced radially apart from the ceramic insulator and axially apart from the insulator shoulder portion.

According to another aspect of the present invention, there is provided a method for manufacturing a spark plug, comprising: providing a ceramic insulator that has a front portion with a stepped outer surface, a middle portion made larger in outer diameter than the front portion, a rear portion made smaller in outer diameter than the middle portion and a shoulder portion defined between the middle and rear portions, a difference between the outer diameters of the middle and rear portions of the ceramic insulator being 1.8 mm or smaller; fixing a center electrode in the ceramic insulator; inserting the ceramic insulator into a metal shell to seat the stepped outer surface of the ceramic insulator against a radially inward protrusion of the metal shell; and crimping a rear end portion of the metal shell onto the shoulder portion of the ceramic insulator in such a manner that an inner circumferential surface of the crimped shell portion has a region held in contact with the insulator shoulder portion with a radially innermost point of the crimped shell portion being spaced radially apart from the ceramic insulator and axially apart from the insulator shoulder portion.

DESCRIPTION OF THE EMBODIMENTS

The present invention will be described below in detail with reference the drawings.

Figure 1:
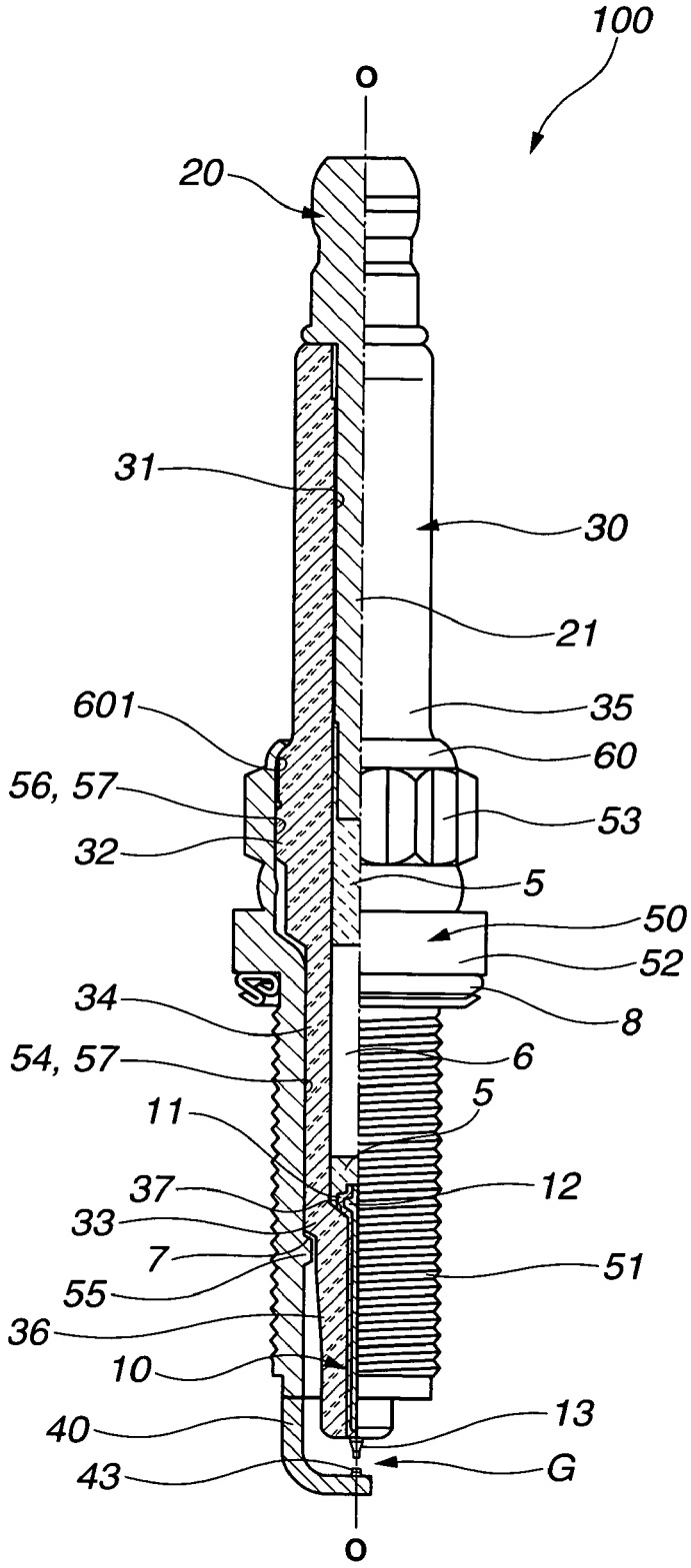
FIG. 1 is a side view, partly in cross section, of a spark plug according to one embodiment of the present invention.
Figure 2A:
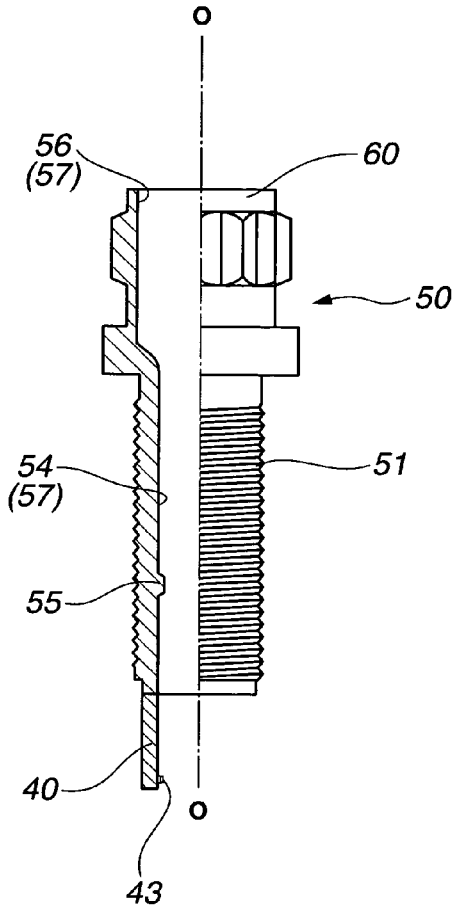
FIG. 2A is a side view, partly in cross section, of the subassembly composed of a metal shell and a ground electrode before assembled into the spark plug according to one embodiment of the present invention.
Figure 2B:
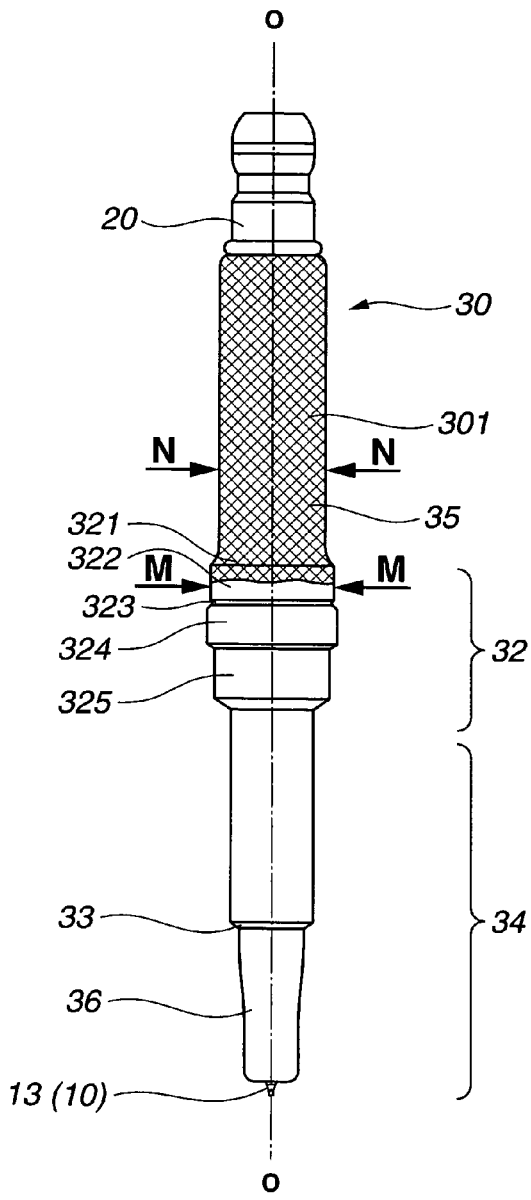
FIG. 2B is a side view, partly in cross section, of the subassembly composed of a ceramic insulator, a center electrode and a terminal electrode before assembled into the spark plug according to one embodiment of the present invention.

As shown in FIGS. 1, 2A and 2B, a spark plug 100 for an internal combustion according one exemplary embodiment of the present invention includes a center electrode 10, a terminal electrode 20, a ceramic insulator 30, a ground electrode 40 and a metal shell 50.

The center electrode 10 has a substantially column-shaped electrode body made of a Ni-alloy material such as Inconel and provided with a flanged rear end portion 11, a core 12 made of a Cu-alloy material and embedded in the center of the electrode body along the direction of the axis O (hereinafter referred to as the "axial direction") of the spark plug 100 for improvement in thermal conductivity and a tip 13 made of a precious-metal alloy material such as Pt- or Ir-alloy material and joined to a front end of the electrode body for improvement in spark dischargeability and wear resistance. The terminal electrode 20 is provided with a leg portion 21. The center electrode 10 and the terminal electrode 20 are arranged coaxially with each other and supported in front and rear sides of the ceramic insulator 30, respectively, with a resistive member 6 and glass seal members 5 disposed between the center electrode 10 and the terminal electrode 20.

The ground electrode 40 has a substantially rectangular electrode body made of a Ni-alloy material and joined to a front end of the metal shell 50 and a tip 43 made of a precious-metal alloy material such as Pt- or Ir-alloy material and joined to a front end portion of the electrode body for improvement in spark dischargeability and wear resistance. The ground electrode body is bent substantially at a right angle in such a manner that the electrode tips 13 and 43 face each other with a spark discharge gap G left therebetween. Although not shown in the drawings, the ground electrode 40 may also have a core made of a Cu-alloy material and embedded in the electrode body.

The ceramic insulator 30 is formed into a substantially cylindrical shape with an axial through-hole 31, by press-molding a mixture of an insulative ceramic powder (such as alumina or aluminum nitride powder) and a binder, grinding the molded article with a grindstone and sintering the resulting molded article, and is provided with a front portion 34, a middle portion 32, a rear portion 35 and a shoulder portion 321. The front insulator portion 34 has a front-facing stepped outer surface 33, a leg 36 extending on a front side of the stepped outer surface 33 to be exposed to combustion gas in the engine and a rear-facing stepped inner surface 37 defined in the through-hole 31 on a rear side of the leg 36 so as to retain thereon the flanged rear end portion 11 of the center electrode 10. Herein, the diameter of the through-hole 31 is made smaller on a front side of the stepped inner surface 37 than on a rear side of the stepped inner surface 37. The rear insulator portion 35 has a substantially constant outer diameter N. The middle insulator portion 32 protrudes radially outwardly from the front and rear insulator portions 34 and 35 and has an outer diameter larger than those of the front and rear insulator portions 34 and 35. In the present embodiment, the middle insulator portion 32 includes a first cylindrical section 322, a second cylindrical section 324 located on a front side of the first cylindrical section 322 and made larger in outer diameter than the first cylindrical section 322, a third cylindrical section 325 located on a front side of the second cylindrical section 324 and made smaller in outer diameter than the first cylindrical section 322 and a recess 323 cut between the first and second cylindrical sections 322 and 324 and tapers down to the front insulator portion 34 as shown in FIG. 2B. Further, the outer diameter of the first cylindrical section 322 is typically regarded as the outer diameter M of the middle insulator portion 32 in the present embodiment. The insulator shoulder portion 321 is formed into a conical shape at a location between the rear insulator portion 35 and the first cylindrical section 322 of the middle insulator portion 32 so as to gradually increase in outer diameter from the rear insulator portion 35 to the first cylindrical section 322 of the middle insulator portion 32.

The metal shell 50 is formed into a substantially cylindrical shape with an axial through-hole 57, by plastic-forming and finishing (e.g. cutting) an iron-based alloy material, and is provided with a threaded portion 51, a plug attachment portion 52 and a tool engagement portion 53. The threaded portion 51 is formed by thread rolling on an outer front surface of the metal shell 50 to be screwed into a plug hole of the engine. The plug attachment portion 52 protrudes radially outwardly on a rear side of the threaded portion 51 to be mounted on a plug mount portion of the engine cylinder head, with a gasket 8 disposed between a mating surface of the plug attachment portion 52 and a mating surface of the plug mount portion of the engine cylinder head to seal the spark plug 100 against the engine cylinder head. The tool engagement portion 53 is formed on a rear side of the plug attachment portion 52 to engage with a tool such as a plug wrench to mount the spark plug 100 into the plug hole. A portion of the metal shell 50 between the plug attachment portion 52 and the tool engagement portion 53 is made small in thickness and buckled during the installation of the ceramic insulator 30 in the metal shell 50. Herein, the through-hole 57 includes two sections: a small-diameter section 54 corresponding in axial position to the threads 51 and a large-diameter section 56 extending on a rear side of the small-diameter section 54 from the plug attachment portion 52 through to the rear end of the metal shell 50.

As shown in FIGS. 1 and 2A, the metal shell 50 has a radially inward protrusion 55 provided in a front side of the small-diameter section 54 of the through-hole 57 so as to retain thereon the stepped outer surface 33 of the ceramic insulator 30 with a plate packing 7 disposed between the stepped insulator surface 33 and the shell protrusion 55 to provide a gas seal between the metal shell 50 and the ceramic insulator 30. The metal shell 50 also has a rear end portion 60 made small in thickness on a rear side of the tool engagement portion 53 and crimped onto the insulator shoulder portion 321 to cover or cap the insulator shoulder portion 321 with the crimped shell portion 60 and thereby hold the ceramic insulator 30 under pressure from the crimped shell portion 60 as shown in FIGS. 1 and 2A.

With such an arrangement, the local load on the ceramic insulator 30 decreases with increase in the area of contact between the crimped shell portion 60 and the insulator shoulder portion 321. The attainment of a larger contact area between the crimped shell portion 60 and the insulator shoulder portion 321 is thus effective in preventing the occurrence of a break in the ceramic insulator 30. (See FIG. 4.) If a radially innermost point Tin of the crimped shell portion 60 (located nearest to the spark plug axis O on the inner circumference of the crimped shell portion 60) comes into contact with the ceramic insulator 30, however, there arises a great possibility that a break becomes developed in the ceramic insulator 30 from the point Tin.

Figure 4:
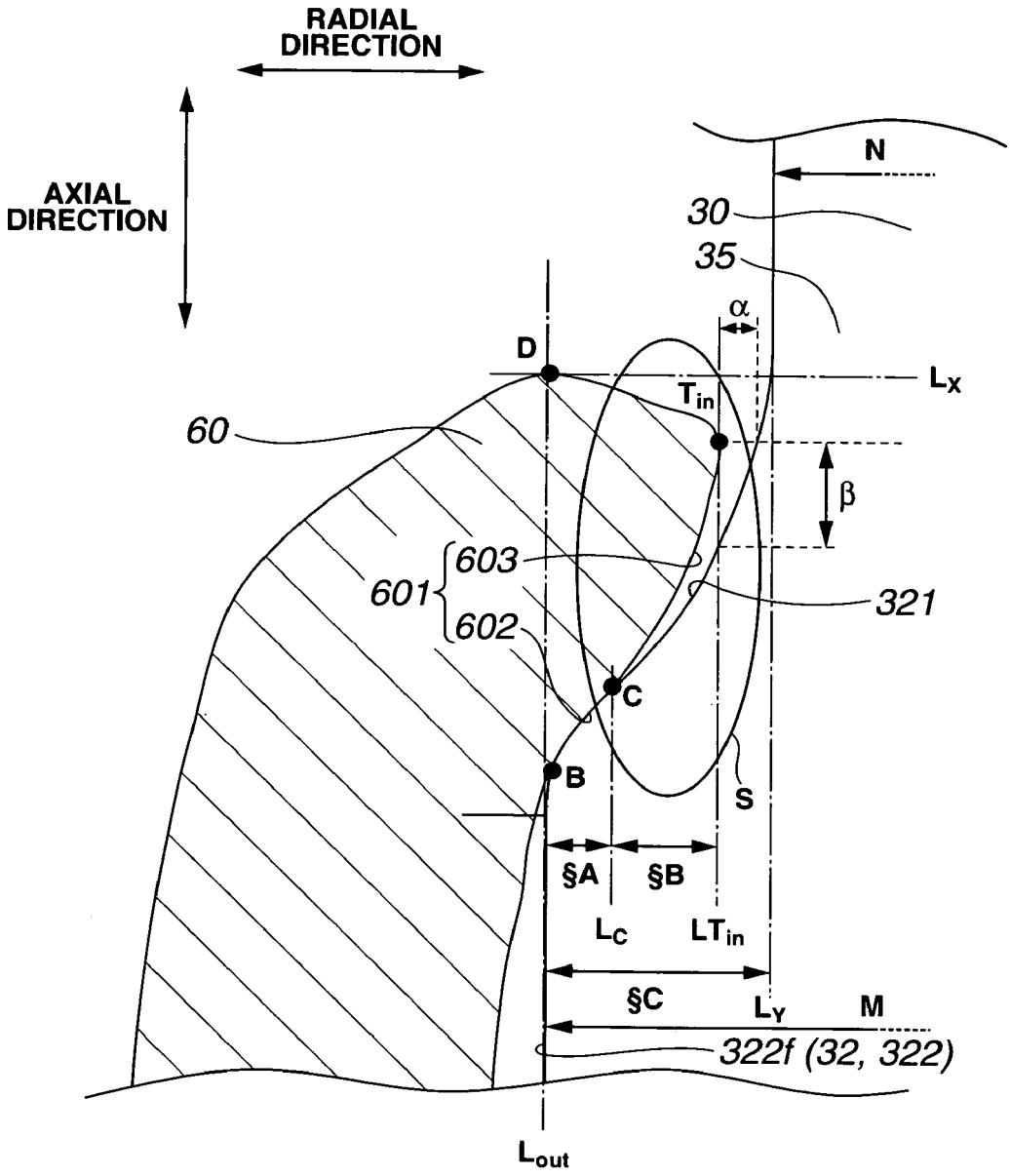
FIG. 4 is an enlarged view showing the positional relationship between a crimped end portion of the metal shell and a shoulder portion of the ceramic insulator in the spark plug according to one embodiment of the present invention.
Figure 5:
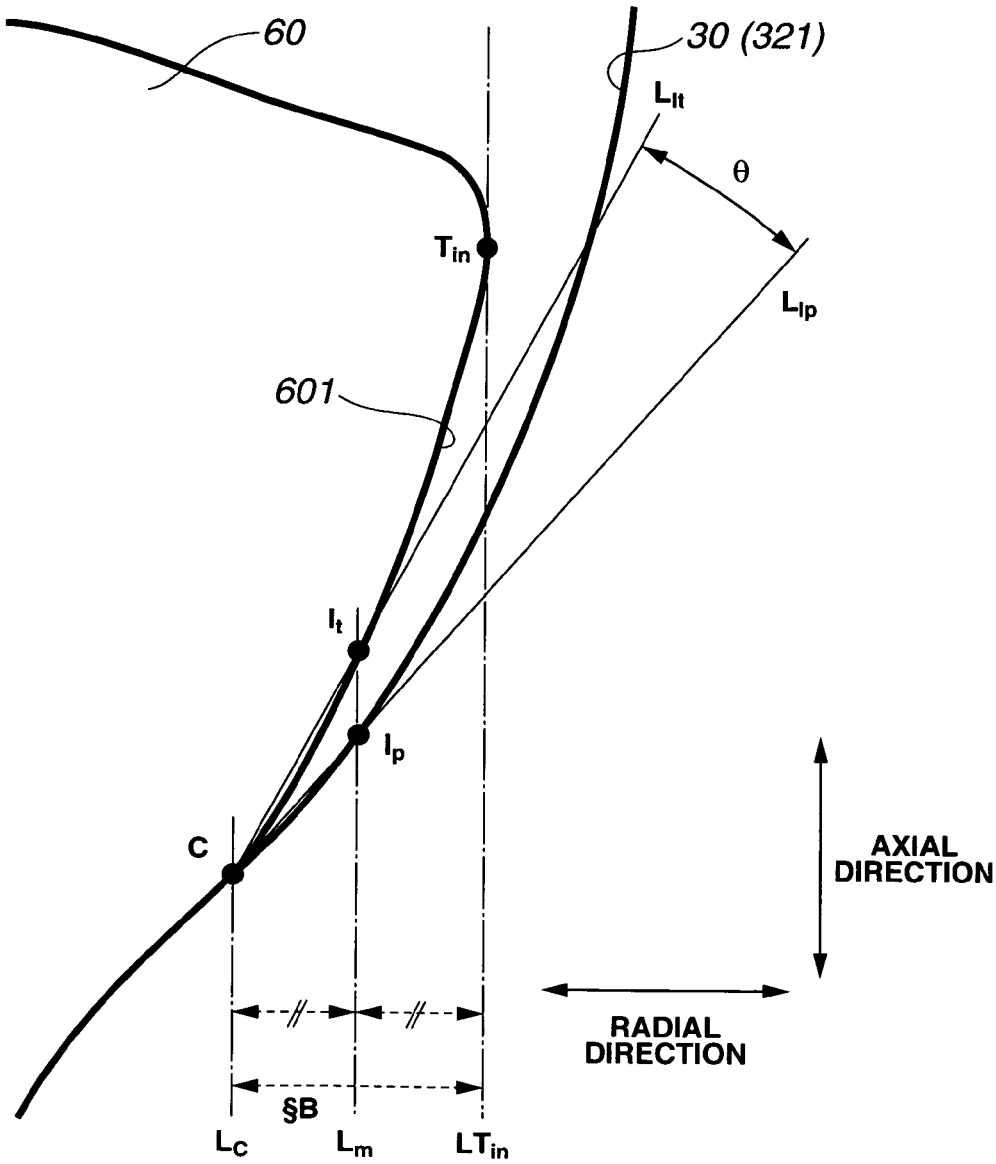
FIG. 5 is an enlarged view of the encircled area S of FIG. 4.

The spark plug 100 is therefore so structured as to space the innermost point Tin of the crimped shell portion 60 radially and axially apart from the ceramic insulator 30, as shown in FIGS. 4 and 5, in order to prevent the occurrence of a break in the ceramic insulator 30. In other words, the metal shell portion 60 is formed (designed) in such a manner that the innermost point Tin of the crimped shell portion 60 is located at a distance a from the outer circumferential surface of the insulator shoulder portion 321 (or the outer circumferential surface of the rear insulator portion 35 ) in the radial direction of the spark plug 100 and at a distance $\beta$ from the outer circumferential surface of the insulator shoulder portion 321 in the axial direction of the sparkplug 100.

When the spark plug 100 is designed as a small-diameter spark plug in which the difference between the outer diameter M of the middle insulator portion 32 and the outer diameter N of the rear insulator portion 35 is 1.8 mm or smaller (notably, e.g. 1.2 mm or smaller), the ceramic insulator 30 is susceptible to breaks. In the present embodiment, however, it becomes possible to prevent the occurrence of a break in the ceramic insulator 30 by the spacing of the innermost point Tin of the crimped shell portion 60 apart from the ceramic insulator 30, even when the spark plug 100 is designed as such a small-diameter spark plug.

In order to prevent the occurrence of a break in the ceramic insulator 30 more effectively, the radial and axial spacing distances $\alpha$ and $\beta$ are preferably controlled to satisfy a relationship of $\alpha<\beta$. It is more preferable to control the radial spacing distance $\alpha$ to 0.05 mm or greater and to control the axial spacing distance $\beta$ to 0.15 mm or greater.

Further, the arrangement of a metal packing between the crimped shell portion 60 and the insulator shoulder portion 321 can become a cause of a break in the ceramic insulator 30 when the spark plug 100 is of small-diameter type. No metal packing is thus arranged between the crimped shell portion 60 and the insulator shoulder portion 321 in order to prevent the occurrence of a break in the ceramic insulator 30 in the present embodiment.

In view of the fact that the ceramic insulator 30 is held under pressure in the metal shell 50 by contact of the crimped shell portion 60 and the insulator shoulder portion 321, it may appear that the crimped shell portion 60 does not need to have a section (including its innermost point Tin) not in contact with the insulator shoulder portion 321. When the crimped shell portion 60 is provided with such a non-contact section, however, the strength of the crimped shell portion 60 increases such that the crimped shell portion 60 becomes able to keep its shape to hold the ceramic insulator 30 in the metal shell 50 securely and thereby maintain good gas tightness between the metal shell 50 and the ceramic insulator 30. For this reason, it is also preferable to control the ratio of coverage of the crimped shell portion 60 on the insulator shoulder portion 321 and the ratio of contact of the crimped shell portion 60 to the insulator shoulder portion 321 appropriately. Not only the spacing of the innermost point Tin of the crimped shell portion 60 apart from the ceramic insulator 30 but also the control of the ratio of coverage of the crimped shell portion 60 on the insulator shoulder portion 321 and the ratio of contact between the crimped shell portion 60 and the insulator shoulder portion 321 are particularly effective in holding the ceramic insulator 30 in the metal shell 50 securely so as to maintain good gas tightness between the metal shell 50 and the ceramic insulator 30, without causing a break in the ceramic insulator 30, when the spark plug 100 is such small-diameter type that the outer diameter N of the rear insulator portion 35 is 11 mm or smaller and that the tool engagement portion 53 is smaller in size than HEX 14 ( 14 mm hexagon).

More specifically, an inner circumferential surface 601 of the crimped shell portion 60 includes two regions: a contact region 602 held in direct contact with the insulator shoulder portion 321 and a non-contact region 603 not in contact with the insulator shoulder portion 321 as shown in FIG. 4. The width §A of the contact region 602 is herein defined as a radial distance between a straight line Lc extending in parallel with the spark plug axis O through a boundary C of the contact region 602 and the non-contact region 603 and a generatrix line Lout of the outer circumferential surface 322*f* of the middle insulator portion 32 (in the present embodiment, of the first cylindrical section 322), when viewed in cross section through the spark plug axis O and the innermost point Tin of the crimped shell portion 60. If the generatrix of the outer circumferential surface 322*f* of the middle insulator portion 32 is extremely inclined with respect to the spark plug axis O, the line Lout is taken as a line extending through a radially outer boundary B of the contact region 602 in parallel with the spark plug axis O. The width §B of the non-contact region 603 is defined as a radial distance from the line Lc to a line LTin extending through the innermost point Tin of the crimped shell portion 60 in parallel with the spark plug axis 0, when viewed in cross section through the spark plug axis O and the innermost point Tin of the crimped shell portion 60. Further, the width §C of the insulator shoulder portion 321 is defined as a radial distance from the line Lout to an extension line Ly of the generatrix of the outer circumferential surface of the rear insulator portion 35, when viewed in cross section through the spark plug axis O and the innermost point Tin of the crimped shell portion 60. It is noted that the width §C of the insulator shoulder portion 321 corresponds to a difference between the outer radius of the middle insulator portion 32 and the outer radius of the rear insulator portion 35, i.e., half the difference between the outer diameter M of the middle insulator portion 32 and the outer diameter N of the rear insulator portion 35.

The ratio of coverage of the crimped shell portion 60 on the insulator shoulder portion 321, (§A+§B)/§C, is preferably controlled to 50% or higher. When the coverage ratio (§A+§B)/§C is 50% or greater, it is possible to hold the ceramic insulator 30 securely in the metal shell 50 and maintain sufficient gas tightness between the metal shell 50 and the ceramic insulator 30 without problems (such as slipping of the ceramic insulator 30 out of the metal shell 50 and gas leakage from between the metal shell 50 and the ceramic insulator 30) occurring due to a decrease in the pressure exerted by the crimped shell portion 60 onto the insulator shoulder portion 321. The coverage ratio (§A+§B)/§C is also preferably controlled to 90% or smaller in order to avoid the innermost point Tin of the crimped shell portion 60 from coming into contact with the ceramic insulator 30 assuredly.

Further, the ratio of contact of the crimped shell portion 602 to the insulator shoulder portion 321, §A/§C, is preferably controlled to 25 to 60%. When the contact ratio §A/§C is 25% or greater, the contact region 602 secures a sufficiently large area so that it is possible to hold the ceramic insulator 30 securely in the metal shell 50 and maintain sufficient gas tightness between the metal shell 50 and the ceramic insulator 30 without problems (such as slipping of the ceramic insulator 30 out of the metal shell 50 and gas leakage from between the metal shell 50 and the ceramic insulator 30) occurring due to a decrease in the pressure exerted by the crimped shell portion 60 onto the insulator shoulder portion 321. When the contact ratio §A/§C is 60% or smaller, it is possible to space the innermost point Tin of the crimped shell portion 60 sufficiently apart from the ceramic insulator 30 and prevent the occurrence of a break in the ceramic insulator 30 assuredly.

In order to hold the ceramic insulator 30 in the metal shell 50 securely without causing a break in the ceramic insulator 30, it is further preferable to satisfy a relationship of $10° \leqq \theta \leqq 25°$, where θ is a narrow angle between two lines Lip and Lit; the line Lip extends from the boundary C through a point Ip of intersection of a line Lm located midway between the lines LTin and Lc and the outer circumferential surface of the insulator shoulder portion 32; and the line Lit extends from the boundary C through a point It of intersection of the line Lm and the inner circumferential surface 601 of the crimped shell portion 60 as shown in FIG. 5. (In FIG. 5, the visible outlines of the crimped shell portion 60 and the ceramic insulator 30 are indicated by heavy lines.) It is noted that the angle θ is approximately equal to a narrow angle formed at the boundary C between the inner circumferential surface 601 of the crimped shell portion 60 and the outer circumferential surface of the insulator shoulder portion 321. When the angle θ is 10° or greater, the innermost point Tin of the crimped shell portion 60 can be spaced sufficiently apart from the ceramic insulator 30 to prevent the occurrence of a break in the ceramic insulator 30 assuredly. If the angle θ is increased excessively, however, the innermost point Tin of the crimped shell portion 60 becomes axially too far apart from the insulator shoulder portion 321. There thus arise problems (such as slipping of the ceramic insulator 30 out of the metal shell 50 and gas leakage from between the metal shell 50 and the ceramic insulator 30 occurring due to a decrease in the pressure exerted by the crimped shell portion 60 onto the insulator shoulder portion 321) due to a decrease in the pressure exerted by the crimped shell portion 60 onto the insulator shoulder portion 321. When the angle θ is 25° or smaller, the ceramic insulator 30 can be held securely in the metal shell 50 without causing such problems due to a decrease in the pressure exerted by the crimped shell portion 60 onto the insulator shoulder portion 321.

For example, the spark plug 100 can be produced with the following exemplary dimensions: M=11.6 mm, N=10.5 mm, §A=0.2 mm, §B=0.2 mm, §C=(M−N)/2=0.55 mm, (§A+§B)/§C=0.73 (73%), §A/§C=0.36 (36%), α=0.08 mm, β=0.2 mm and θ=17°. Further, the tool engagement portion 53 can be of Bi-HEX14 type (14 mm bi-hexagon) in the present embodiment.

When the spark plug 100 is of small diameter type, the metal shell 50 is generally reduced in thickness and diameter. The carbon content of the iron-based alloy material of the metal shell 100 is thus preferably controlled to 0.15 to 0.35% in order to provide sufficient shell strength and ease of forming. Examples of the iron-based alloy material with a carbon content of 0.15 to 0.35% are steel material such as S45C and S355C and stainless alloy. If the carbon content is less than 0.15%, the metal shell 50 of reduced thickness and diameter may not be able to attain sufficient strength. If the carbon content exceeds 0.35%, the metal shell 50 of reduced thickness and diameter becomes too low in toughness and impact resistance. In addition, the hardness of the iron-based alloy material becomes high so that the metal shell 50 cannot be readily formed into a desired shape.

The process of assembling the spark plug 100 will be next explained below with reference to FIG. 3.

The center electrode 10, the terminal electrode 20 and the ceramic insulator 30 are assembled together into a unit by a so-called glass seal process. The glass seal process can be performed as follows. The center electrode 10 is first inserted into the through-hole 31 of the ceramic insulator 30 to seat the flanged rear end portion 11 of the center electrode 10 against the stepped inner surface 37 of the ceramic insulator 30. Next, a first glass seal material, a resistive material and a second glass seal material are filled, in order of mention, into the through-hole 31 of the ceramic insulator 30. Each of the first and second glass seal materials is a mixture of glass powder and metal powder. The resistive material is also a mixture of glass powder and metal powder but with a different mixing ratio. The terminal electrode 20 is inserted into the through-hole 31 of the ceramic insulator 30 so as to embed the leg portion 21 of the terminal electrode 20 in the second glass seal material. The resulting insulator subassembly unit is heated to a predetermined temperature in a furnace. The terminal electrode 20 is pushed in position during the heating. When the insulator subassembly unit is taken out of the furnace, the first and second glass seal materials and the resistive material harden to form the glass seal members 5 and the resistive member 6, respectively. With this, the center electrode 10 and the terminal electrode 20 are fixed in the ceramic insulator 30 with electrical continuity via these members 5 and 6.

Before or simultaneously with the above glass seal process, a glaze layer 301 is formed by applying, drying and sintering a slurry of glazing material (e.g. borosilicate glass) on a part of the ceramic insulator 30 from the insulator rear end to the first cylindrical section 322 as indicated by crosshatching in FIG. 2B.

On the other hand, the ground electrode 40 and the metal shell 50 are assembled together into a unit by resistance welding the rear end of the ground electrode 40 to the front end of the metal shell 50. The resulting shell subassembly unit is given plating (e.g. zinc or nickel plating) after removing welding drips although the plating layer is not shown in the drawings.

Figure 3A:
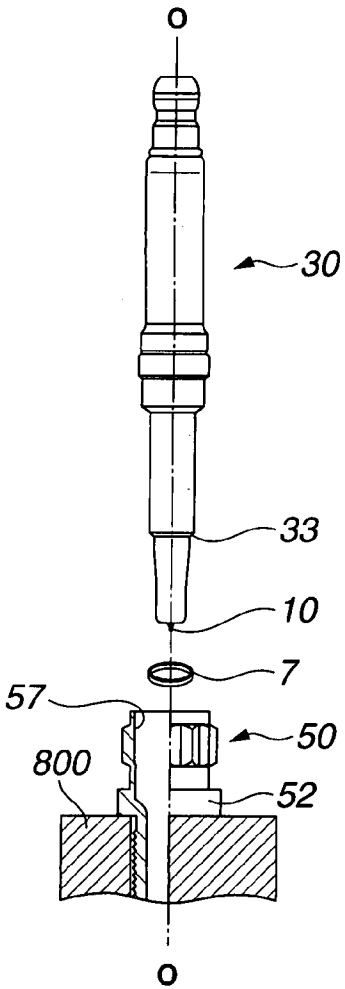
FIGS. 3A to 3D are schematic views showing how the spark plug comes assembled according to one embodiment of the present invention.

As shown in FIG. 3A, the shell subassembly unit is placed in an assembling jig to seat the plug attachment portion 52 of the metal shell 50 against a plug holder 800 of the assembling jig. After that, the insulator subassembly unit is inserted into the through-hole 57 of the metal shell 50 to seat the stepped outer surface 33 of the ceramic insulator 30 against the inward protrusion 55 of the metal shell 50 with the plate packing 7 disposed between the stepped insulator surface 33 and the shell protrusion 55.

Figure 3B:
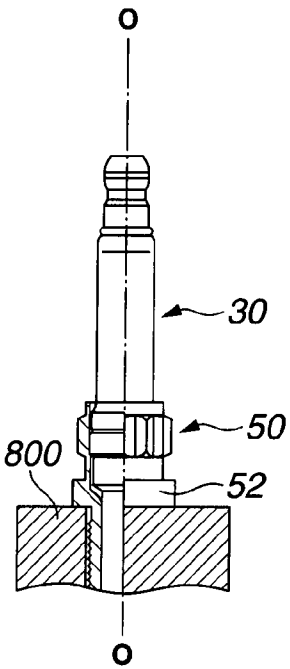

The ceramic insulator 30 is temporarily fixed in such a manner that the shoulder portion 321 of the ceramic insulator 30 becomes located on the front side of the rear end of the metal shell 50 as shown in FIG. 3B.

Figure 3C:
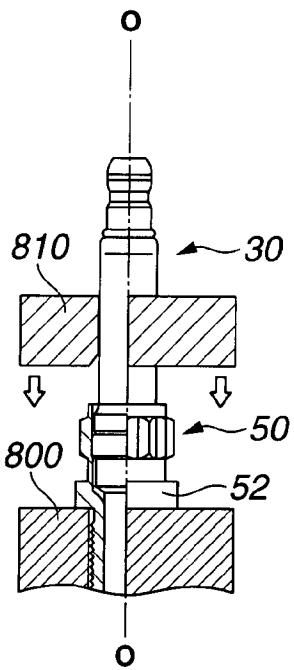
Figure 3D:
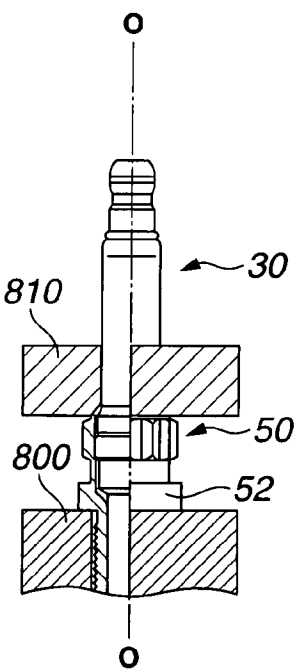

As shown in FIG. 3C, the rear end portion 60 of the metal shell 50 is temporarily crimped onto the shoulder portion 321 of the ceramic insulator 30 using a crimping jig 810. The rear end portion 60 of the metal shell 50 is then properly crimped onto the shoulder portion 321 of the ceramic insulator 30 by a so-called hot crimping process, i.e., by pushing the crimping jig 810 down onto the metal shell 50 while energizing the metal shell 50 from an electrical power source via the plug holder 800 and the crimping jig 810 as shown in FIG. 3D.

Finally, the ground electrode 40 is bent in such a manner that the spark discharge gap G is formed between the electrode tips 13 and 43.

The present invention will be described in more detail by reference to the following examples. It should be however noted that the following examples are only illustrative and not intended to limit the invention thereto.

EXPERIMENT 1

Five types of samples of the spark plug 100 (5 samples for each type, 25 samples in total) were produced in the same way as described above by varying the length of the rear end portion 60 of the metal shell 50 (as measured before the crimping process). The plug components of the samples used were those for general-purpose spark plugs. Further, the crimping process was performed using the same crimping jig through the application of a tightening torque of 25 N·m so as to attain the same bending degree (angle) for all of the samples. The dimensions of the samples are indicated in TABLE 1.

Each of the samples was tested for the gas tightness between the metal shell 50 and the ceramic insulator 30 as follows. In the test sample, a gas hole was made through the metal shell 50 at a position between the plug attachment portion 52 and the tool engagement portion 53 to communicate with the through-hole 57. A flow of air gas was injected into the test sample from its front side with 1.5 MPa of gas pressure, to monitor the amount of gas leaking through the gas hole per minute while gradually heating up the test sample. It was judged that it became impossible to maintain gas tightness between the metal shell 50 and the ceramic insulator 30 by the packing 7 at the time the gas leak exceeded 10 cc/min. Upon judgment, the mating surface temperature of the plug attachment portion 52 of the metal shell 50 was determined as a measure of the gas tightness between the metal shell 50 and the ceramic insulator 30. The test results are indicated in TABLE 1 and FIG. 6. (In FIG. 6, the numbers assigned to the plot points represent the sample types.)

Figure 6:
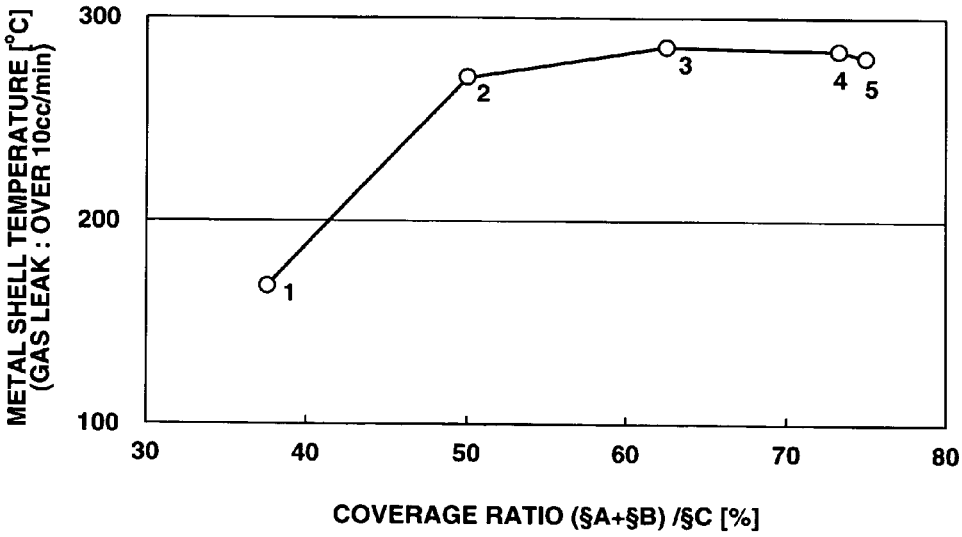
FIG. 6 is a graph showing test results on the correlation between the gas tightness of the spark plug and the ratio of coverage of the crimped shell portion on the insulator shoulder portion.

It has been demonstrated from TABLE 1 and FIG. 6 that the plug gas tightness can be maintained at a sufficient degree even under considerably high temperature conditions when the coverage ratio (§A+§B)/§C is 50% or greater.

TABLE 1

| | Plug Dimensions | | | Average Gas Leakage |
|---|---|---|---|---|
| Sample Type | (§A + §B) [mm] | §C [mm] | (§A + §B)/§C [%] | Temperature [° C.] |
| 1 | 0.150 | 0.400 | 38 | 168.5 |
| 2 | 0.200 | 0.400 | 50 | 270.2 |
| 3 | 0.250 | 0.400 | 62 | 285.2 |
| 4 | 0.293 | 0.400 | 73 | 283.5 |
| 5 | 0.300 | 0.400 | 75 | 280.3 |

EXPERIMENT 2

Seven types of samples of the spark plug 100 (5 samples for each type, 35 samples in total) were produced in the same way as in Experiment 1, except that the crimping process was performed using different crimping jigs to vary the shape of the crimped shell portion 60 and the area of the contact region 602 of the crimped shell portion 60 although the rear end portion 60 of the metal shell 50 was set at the same length for all of the test samples. The dimensions of the samples are indicated in TABLE 2.

The samples were tested for the gas tightness between the metal shell 50 and the ceramic insulator 30 in the same way as in Experiment 1. The test results are indicated in TABLE 2 and FIG. 7. (In FIG. 7, the numbers assigned to the plot points represent the sample types.)

Figure 8:
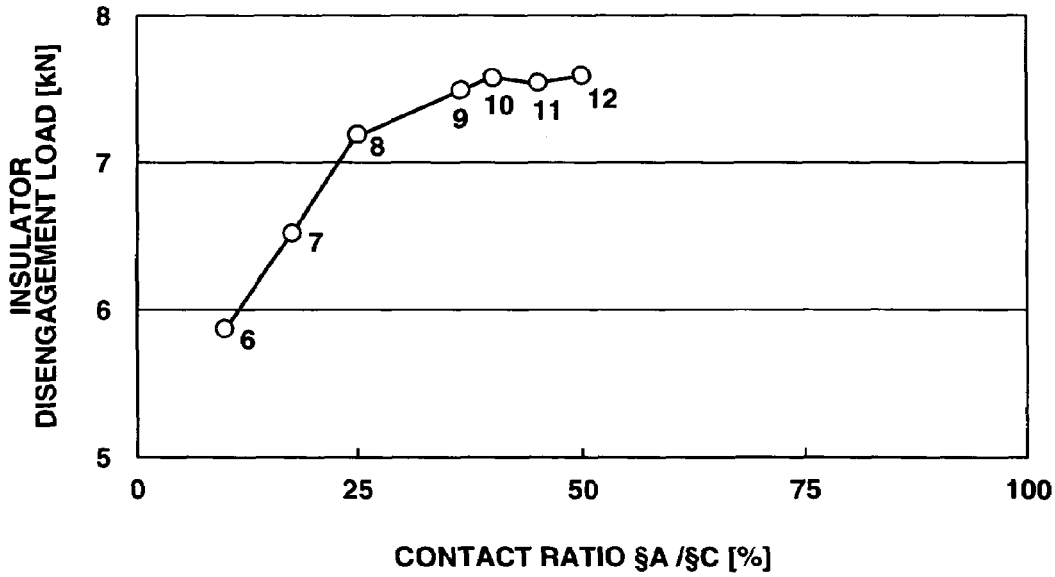
FIG. 8 is a graph showing test results on the correlation between the insulator holding power of the metal shell and the ratio of contact of the crimped shell portion to the insulator shoulder portion.

The samples were also tested for the power of the crimped shell portion 60 to hold the ceramic insulator 30 as follows. The test sample was fixed on a sample stage by screwing the threads 51 into a threaded vertical through-hole of the sample stage so that a front end of the ceramic insulator 30 was exposed at an upper surface of the sample stage. A press member was pressed down onto the exposed end of the ceramic insulator 30 to apply a load gradually increasingly onto the ceramic insulator 30. The load applied to the ceramic insulator 30 (referred to as an "insulator disengagement load") immediately before disengagement of the ceramic insulator 30 from the metal shell 50, without the ceramic insulator 30 being held by the crimped shell portion 60, was determined as a measure of the insulator holding power. The test results are indicated in TABLE 2 and FIG. 8. (In FIG. 8, the numbers assigned to the plot points represent the sample types.)

Figure 7:
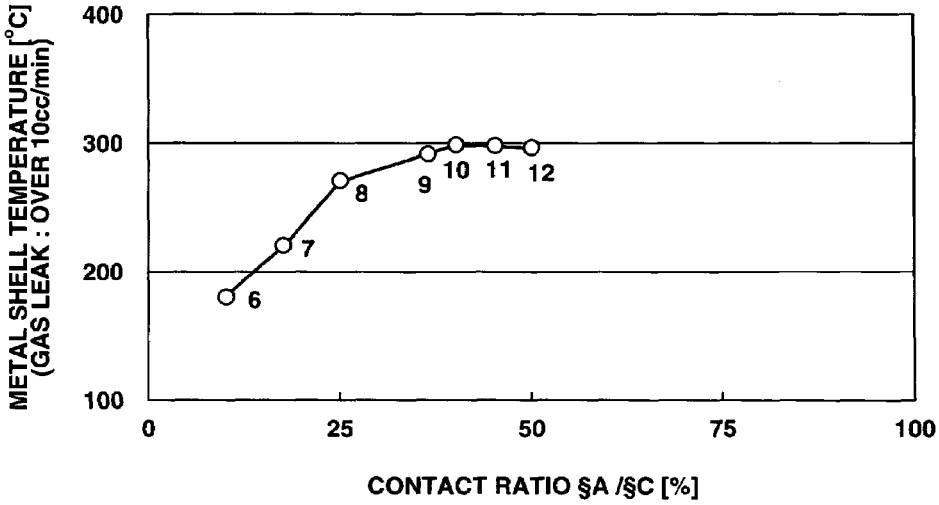
FIG. 7 is a graph showing test results on the correlation between the gas tightness of the spark plug and the ratio of contact of the crimped shell portion to the insulator shoulder portion.

It has been demonstrated from TABLE 2 and FIG. 7 that the plug gas tightness can maintained at a sufficient degree even under considerably high temperature conditions when the contact ratio §A/§C was 25% or greater. Further, it has been demonstrated from TABLE 2 and FIG. 8 that the insulator holding power can be increased to considerably high degrees when the contact ratio §A/§C is 25% or higher.

TABLE 2

| | Plug Dimensions | | | Average Gas Leakage | Average Disengagement |
|---|---|---|---|---|---|
| Sample Type | §A [mm] | §C [mm] | §A/§C [%] | Temperature [° C.] | Load [kN] |
| 6 | 0.04 | 0.40 | 10 | 180.5 | 5.876 |
| 7 | 0.07 | 0.40 | 18 | 220.3 | 6.516 |
| 8 | 0.10 | 0.40 | 25 | 270.5 | 7.186 |
| 9 | 0.15 | 0.40 | 36 | 290.2 | 7.489 |
| 10 | 0.16 | 0.40 | 40 | 298.2 | 7.576 |
| 11 | 0.18 | 0.40 | 45 | 297.6 | 7.530 |
| 12 | 0.20 | 0.40 | 50 | 296.3 | 7.582 |

EXPERIMENT 3

Seven types of samples of the spark plug 100 (5 samples for each type, 35 samples in total) were produced in the same way as in Experiment 2. The dimensions of the test samples are indicated in TABLE 3.

The samples were subjected to Charpy test as follows according to JIS B7722 in order to evaluate the resistance of the ceramic insulator 30to breaking. The test sample was fixed on a sample stage by screwing the threads into a threaded vertical through-hole of the sample stage with a front end of the spark plug directed downward. A hammer was fastened pivotally about a point above the spark plug 100 on the spark plug axis O. A head of the hammer was lifted to some height, and then, released to fall freely to collide with a part of the ceramic insulator 30 located at a distance of about 1 mm from the insulator rear end. The above test procedure was repeated by gradually increasing the hammer head lifting angle by given degrees. The breaking energy of the ceramic insulator 30 was determined, as a measure of the insulator breaking resistance, based on the hammer head lifting angle at which the ceramic insulator was broken. The test results are indicated in TABLE 3 and FIG. 9. (In FIG. 9, the numbers assigned to the plot points represent the sample types.)

Figure 9:
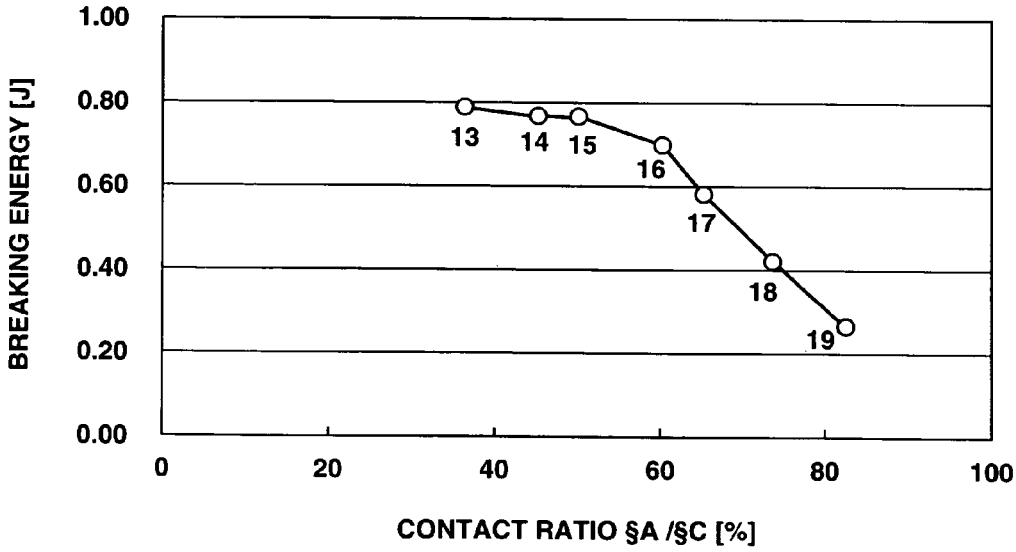
FIG. 9 is a graph is a graph showing test results on the correlation between the breaking resistance of the ceramic insulator and the ratio of contact of the crimped shell portion to the insulator shoulder portion.

It has been demonstrated from TABLE 3 and FIG. 9 that the insulator breaking resistance can be increased to considerably high degrees when the contact ratio §A/§C is 60% or smaller.

TABLE 3

| | Plug Dimensions | | | Average Breaking |
|---|---|---|---|---|
| Sample Type | §A [mm] | §C [mm] | §A/§C [%] | Energy [J] |
| 13 | 0.15 | 0.40 | 36 | 0.7880 |
| 14 | 0.18 | 0.40 | 45 | 0.7693 |

TABLE 3-continued

| | Plug Dimensions | | | Average Breaking |
|---|---|---|---|---|
| Sample Type | §A [mm] | §C [mm] | §A/§C [%] | Energy [J] |
| 15 | 0.20 | 0.40 | 50 | 0.7693 |
| 16 | 0.24 | 0.40 | 60 | 0.7029 |
| 17 | 0.26 | 0.40 | 65 | 0.5823 |
| 18 | 0.29 | 0.40 | 73 | 0.4248 |
| 19 | 0.33 | 0.40 | 82 | 0.2672 |

EXPERIMENT 4

Five types of samples of the spark plug 100 (5 samples for each type, 25 samples in total) were produced in the same way as in Experiments 1 and 2, except that the crimping process was performed using crimping jigs of different shapes to vary the bending degree (angle) of the crimped shell portion 60. The dimensions of the samples are indicated in TABLE 4.

The samples were tested for the gas tightness between the metal shell 50 and the ceramic insulator 30 in the same way as in Experiments 1 and 2. The test results are indicated in TABLE 4 and FIG. 10. (In FIG. 10, the numbers assigned to the plot points represent the sample types.)

Figure 11:
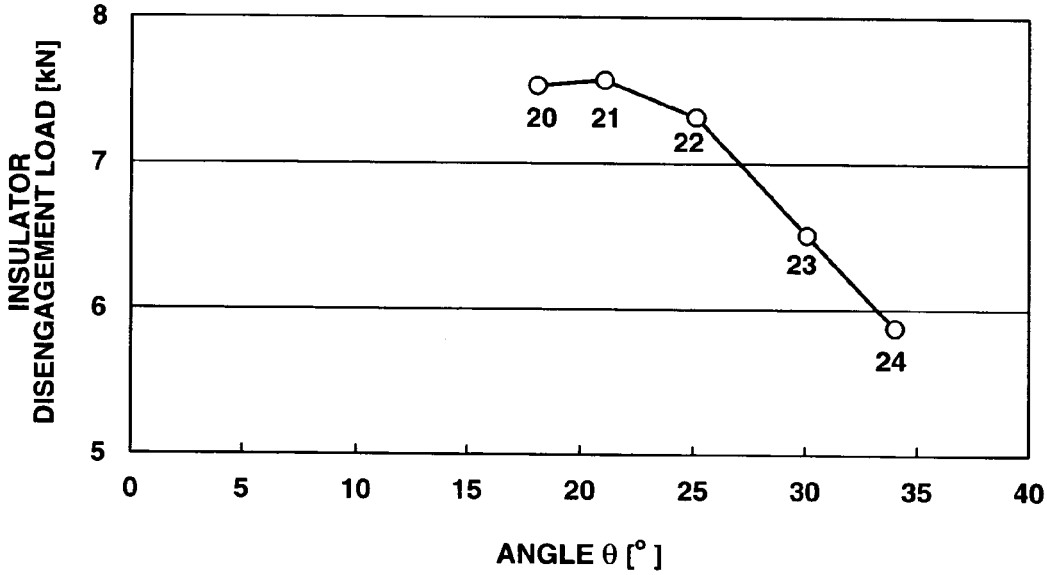
FIG. 11 is a graph showing test results on the correlation between the insulator holding power of the metal shell and the angle of the crimped shell portion relative to the insulator shoulder portion.

The samples were also tested for the power of the crimped shell portion 60 to hold the ceramic insulator 30 in the same way as in Experiment 2. The test results are indicated in TABLE 4 and FIG. 11. (In FIG. 11, the numbers assigned to the plot points represent the sample types.)

Figure 10:
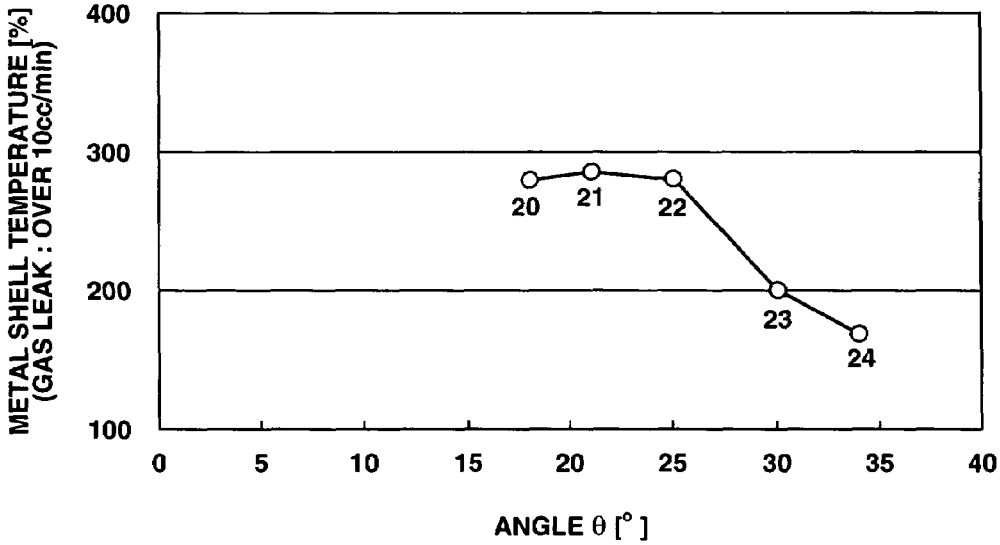
FIG. 10 is a graph showing test results on the correlation between the gas tightness of the spark plug and the angle of the crimped shell portion relative to the insulator shoulder portion.

It has been demonstrated from TABLE 4 and FIG. 10 that the plug gas tightness can be maintained under considerably high temperature conditions when the angle θ is 25° or smaller. It has been demonstrated from TABLE 4 and FIG. 11 that the insulator holding power can be increased to considerably high degrees when the angle θ is 25° or smaller.

TABLE 4

| Sample Type | Plug Dimensions Angle θ [°] | Average Gas Leakage Temperature [° C.] | Average Disengagement Load [kN] |
|---|---|---|---|
| 20 | 18 | 280.0 | 7.530 |
| 21 | 21 | 285.3 | 7.576 |
| 22 | 25 | 280.5 | 7.318 |
| 23 | 30 | 200.3 | 6.516 |
| 24 | 34 | 168.5 | 5.876 |

EXPERIMENT 5

Five types of samples of the spark plug 100 (5 samples for each type, 25 samples in total) were produced in the same way as in Experiment 4. The dimensions of the samples are indicated in TABLE 5.

The samples were subjected to Charpy test in the same way as in Experiment 3 in order to evaluate the resistance of the ceramic insulator 30 to breaking. The test results are indicated in TABLE 5 and FIG. 12. (In FIG. 12, the numbers assigned to the plot points represent the sample types.)

Figure 12:
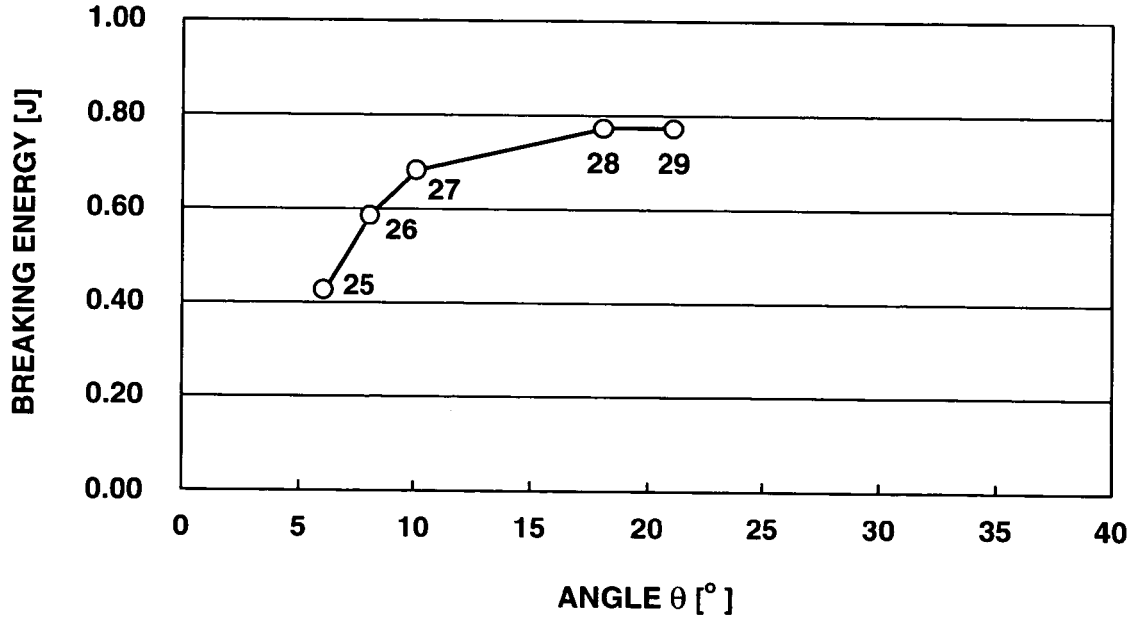
FIG. 12 is a graph showing test results on the correlation between the breaking resistance of the ceramic insulator and the angle of the crimped shell portion relative to the insulator shoulder portion.

It has been demonstrated from TABLE 5 and FIG. 12 that the insulator breaking resistance can be increased to considerably high degrees when the angle θ is 10° or greater.

TABLE 5

| Sample Type | Plug Dimensions Angle θ [°] | Average Breaking Energy [J] |
|---|---|---|
| 25 | 6 | 0.4248 |
| 26 | 8 | 0.5837 |
| 27 | 10 | 0.6812 |
| 28 | 18 | 0.7693 |
| 29 | 21 | 0.7693 |

EXPERIMENT 6

Six types of samples of the spark plug 100 (5 samples for each type, 30 samples in total) were produced in the same way as in Experiments 1, 2 and 4 except that the carbon content of the iron-based material of the metal shell 50 was varied as indicated in TABLE 6.

The samples were tested for the gas tightness between the metal shell 50 and the ceramic insulator 30 in the same way as in Experiments 1, 2 and 4. The test results are indicated in TABLE 6 and FIG. 13. (In FIG. 13, the numbers assigned to the plot points represent the sample types.)

Figure 14:
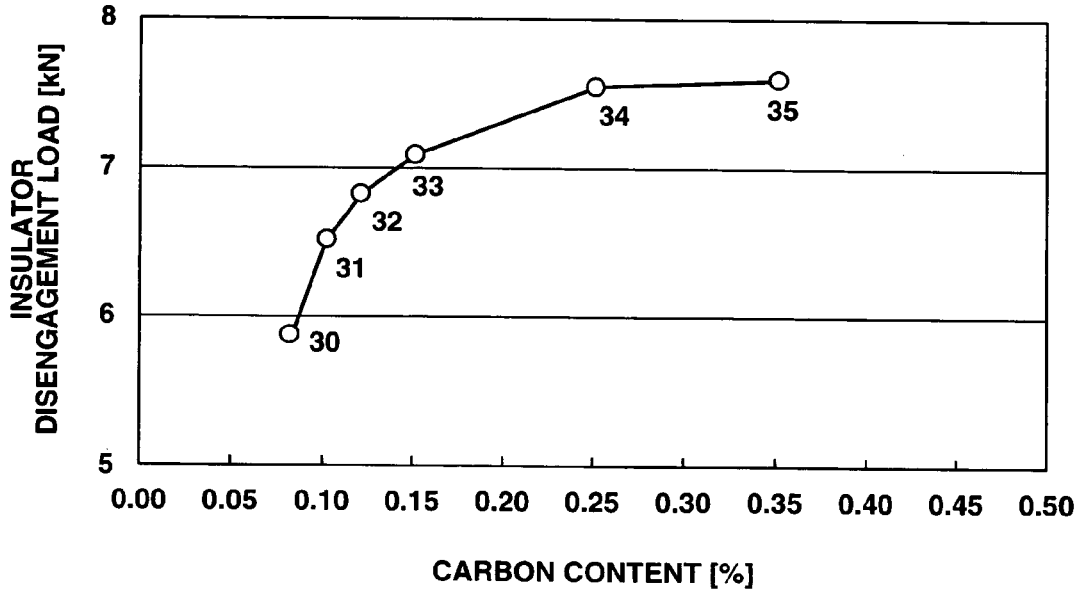
FIG. 14 is a graph showing test results on the correlation between the insulator holding power of the metal shell and the carbon content of the iron-based alloy material of the metal shell.

The samples were also tested for the power of the crimped shell portion 60 to hold the ceramic insulator 30 in the same way as in Experiments 2 and 4. The test results are indicated in TABLE 6 and FIG. 14. (In FIG. 14, the numbers assigned to the plot points represent the sample types.)

Figure 13:
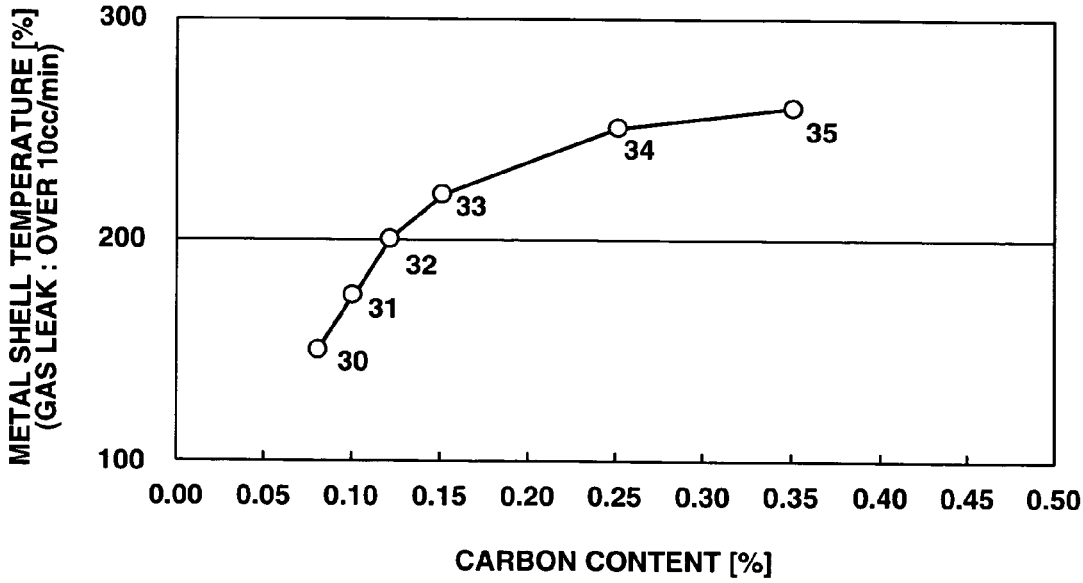
FIG. 13 is a graph showing test results on the gas tightness of the spark plug and the carbon content of the iron-based alloy material of the metal shell.

It has been demonstrated from TABLE 6 and FIG. 13 that the plug gas tightness can be maintained at a sufficient degree even under considerably high temperature conditions when the carbon content of the metal shell material is 0.15% or greater. Further, it has been demonstrated from TABLE 6 and FIG. 14 that the insulator holding power can be increased to considerably high degrees when the carbon content of the metal shell material is 0.15% or greater.

TABLE 6

| Sample Type | Shell Material Carbon Content [%] | Average Gas Leakage Temperature [° C.] | Average Disengagement Load [kN] |
|---|---|---|---|
| 30 | 0.08 | 150.6 | 5.876 |
| 31 | 0.10 | 175.2 | 6.516 |
| 32 | 0.12 | 200.2 | 6.813 |
| 33 | 0.15 | 220.5 | 7.086 |
| 34 | 0.25 | 250.5 | 7.530 |
| 35 | 0.35 | 260.2 | 7.582 |

As described above, it is possible in the present embodiment to hold the ceramic insulator 30 in the metal shell 50 securely and maintain good gas tightness between the metal shell 50 and the ceramic insulator 30, without causing a break in the ceramic insulator 30, by spacing the innermost point Tin of the crimped shell portion 60 apart from the ceramic insulator 30 and by controlling the coverage ratio (§A+§B)/§C the contact ratio §A/§C, the angle θ and the carbon content of the metal shell material to within the specific ranges, even when the spark plug 100 is of small-diameter type.

The entire contents of Japanese Patent Application No. 2005-254211 (filed on Sep. 1, 2005), No. 2006-048684 (filed on Feb. 24, 2006) and No. 2006-187505 (filed on Jul. 7, 2006) are herein incorporated by reference.

Although the present invention has been described with reference to the above exemplary embodiment of the invention, the invention is not limited to the above-specific exemplary embodiment. Various modification and variation of the embodiment described above will occur to those skilled in the art in light of the above teaching. For example, the shell end portion 60 can alternatively be crimped onto the insulator shoulder portion 321 by cold forging (plastic forming without energization). Although the recess 323 and the different-diameter cylindrical sections 322, 324 and 325 are provided in the middle insulator portion 32 in the above embodiment, the middle insulator portion 32 may not be formed with such a stepwise structure. The rear insulator portion 35 may not be of constant outer diameter (i.e. the generatrix of the outer circumferential surface of the rear insulator portion 35 may not be in parallel with the spark plug axis O). In this case, the outer diameter N of the rear insulator portion 35 is measured along a plane Lx extending through the rearmost point D of the crimped shell end 60 in a direction perpendicular to the spark plug axis O as shown in FIG. 4. Further, the insulator shoulder portion 321 may alternatively be formed into a taper shape. The scope of the invention is defined with reference to the following claims.

What is claimed is:

1. A spark plug, comprising:

a center electrode;

a ceramic insulator being formed with an axial through-hole to support therein the center electrode and including a front portion with a stepped outer surface, a middle portion made larger in outer diameter than the front portion, a rear portion made smaller in outer diameter than the middle portion and a shoulder portion defined between the middle and rear portions, a difference between the outer diameters of the middle and rear portions of the ceramic insulator being 1.8 mm or smaller;

a metal shell being formed with an axial through-hole to hold therein the ceramic insulator and including a tool engagement portion adapted to engage with a plug mounting tool, a radially inward protrusion formed in the axial through-hole of the metal shell to retain thereon the stepped outer surface of the ceramic insulator and a crimped portion located on a rear side of the tool engagement portion and crimped onto the shoulder portion of the ceramic insulator, an inner circumferential surface of the crimped portion having a region held in direct contact with the shoulder portion with a radially innermost point of the crimped portion being spaced radially apart from the ceramic insulator and axially apart from the shoulder portion, wherein the crimped portion of the metal shell and the shoulder portion of the ceramic insulator satisfy the relationships of $0.5 \leqq (\S A+\S B)/\S C$ and $0.25 \leqq \S A/\S C \leqq 0.6$ where, when viewed in cross section through an axis of the spark plug and the radially innermost point of the crimped portion, §A is a radial distance from an outer generatrix line of the middle portion of the ceramic insulator to a first imaginary line extending through a radially innermost point of said region in contact with the shoulder portion in parallel with the spark plug axis; §B is a radial distance from the first imaginary line to a second imaginary line extending through the radially innermost point of the crimped portion in parallel with the spark plug axis: and §C is a difference between outer radii of the middle and rear portions of the ceramic insulator.

2. The spark plug according to claim 1, wherein the outer diameter of the rear portion of the ceramic insulator is 11 mm or smaller.

3. The spark plug according to claim 1, wherein the crimped portion of the metal shell and the shoulder portion of the ceramic insulator satisfy the relationship of $10° \leqq \theta \leqq 25°$, where θ is a narrow angle between third and fourth imaginary lines; the third imaginary line extends from the radially innermost point of said region through a point of intersection of a fifth imaginary line located midway between the first and second imaginary lines and an outer circumferential surface of the insulator shoulder; and the fourth imaginary line extends from the radially innermost point of said region through a point of intersection of the fifth imaginary line and the inner circumferential surface of the crimped portion.

4. The spark plug according to claim 1, wherein the metal shell is made of an iron-based alloy material having a carbon content of 0.15 to 0.35%.

5. The spark plug according to claim 1, wherein the radially innermost point of the crimped portion is located at a first distance radially from the ceramic insulator and at a second distance axially from the insulator shoulder portion; and the first distance is smaller than the second distance.

6. The spark plug according to claim 5, wherein the first distance is 0.05 mm or greater; and the second distance is 0.15 mm or greater.

7. A method for manufacturing a spark plug, said spark plug comprising:

a center electrode;

a ceramic insulator being formed with an axial through-hole to support therein the center electrode and including a front portion with a stepped outer surface, a middle portion made larger in outer diameter than the front portion, a rear portion made smaller in outer diameter than the middle portion and a shoulder portion defined between the middle and rear portions, a difference between the outer diameters of the middle and rear portions of the ceramic insulator being 1.8 mm or smaller;

a metal shell being formed with an axial through-hole to hold therein the ceramic insulator and including a tool engagement portion adapted to engage with a plug mounting tool, a radially inward protrusion formed in the axial through-hole of the metal shell to retain thereon the stepped outer surface of the ceramic insulator and a crimped portion located on a rear side of the tool engagement portion and crimped onto the shoulder portion of the ceramic insulator, an inner circumferential surface of the crimped portion having a region held in direct contact with the shoulder portion with a radially innermost point of the crimped portion being spaced radially apart from the ceramic insulator and axially apart from the shoulder portion, wherein the crimped portion of the metal shell and the shoulder portion of the ceramic insulator satisfy the relationships of $0.5 \leqq (\S A+\S B)/\S C$ and $0.25 \leqq \S A/\S C \leqq 0.6$ where, when viewed in cross section through an axis of the spark plug and the radially innermost point of the crimped portion, §A is a radial distance from an outer generatrix line of the middle portion of the ceramic insulator to a first imaginary line extending through a radially innermost point of said region in contact with the shoulder portion in parallel with the spark plug axis; §B is a radial distance from the first imaginary line to a second imaginary line extending through the radially innermost point of the crimped portion in parallel with the spark plug axis; and §C is a difference between outer radii of the middle and rear portions of the ceramic insulator, said method comprising:

providing a ceramic insulator that has a front portion with a stepped outer surface, a middle portion made larger in outer diameter than the front portion, a rear portion made smaller in outer diameter than the middle portion and a shoulder portion defined between the middle and rear portions, a difference between the outer diameters of the middle and rear portions of the ceramic insulator being 1.8 mm or smaller;

fixing a center electrode in the ceramic insulator;

inserting the ceramic insulator into a metal shell to seat the stepped outer surface of the ceramic insulator against a radially inward protrusion of the metal shell;

crimping a rear end portion of the metal shell onto the shoulder portion of the ceramic insulator in such a manner that an inner circumferential surface of the crimped shell portion has a region held in contact with the insulator shoulder portion with a radially innermost point of the crimped shell portion being spaced radially apart from the ceramic insulator and axially apart from the insulator shoulder portion, and during said crimping, allowing the crimped shell portion and the insulator shoulder portion to satisfy the relationships of $0.5 \leqq (\S A+\S B)/\S C$ and $0.25 \leqq \S A/\S C \leqq 0.6$ where, when viewed in cross section through an axis of the spark plug and the radially innermost point of the crimped shell portion, §A is a radial distance from an outer generatrix line of the middle portion of the ceramic insulator to a first imaginary line extending through a radially innermost point of said region in contact with the shoulder portion in parallel with the spark plug axis; §B is a radial distance from the first imaginary line to a second imaginary line extending through the radially innermost point of the crimped shell portion in parallel with the spark plug axis; and §C is a difference between outer radii of the middle and rear portions of the ceramic insulator.

* * * * *